United States Patent [19]

Botta

[11] Patent Number: 4,722,578

[45] Date of Patent: Feb. 2, 1988

[54] SHOWCASE STRUCTURE

[76] Inventor: Luigi Botta, Via S. Ruffillo 11, Ponticella di S Lazzaro di Savena Prov. of Bologna, Italy

[21] Appl. No.: 854,391

[22] Filed: Apr. 21, 1986

[30] Foreign Application Priority Data

May 6, 1985 [IT] Italy ..... 4882/85[U]

[51] Int. Cl.[4] ..... A47B 51/00

[52] U.S. Cl. ..... 312/312; 49/360; 312/110; 312/138 R; 312/139

[58] Field of Search ..... 312/139, 138 R, 312, 312/110, 109; 49/360; 108/147

[56] References Cited

U.S. PATENT DOCUMENTS

| | | | |
|---|---|---|---|
| 478,619 | 7/1892 | Loughry | 312/139 |
| 559,159 | 4/1896 | Bower | 312/139 |
| 687,815 | 12/1901 | Coe | 312/139 |
| 754,814 | 3/1904 | Schriefer | 312/109 X |
| 934,526 | 9/1909 | Heusser | 312/138 R |
| 1,091,670 | 3/1914 | Kump | 312/138 R |
| 1,483,723 | 2/1924 | Fredholm | 312/139 |
| 2,478,145 | 8/1949 | Weber | 312/312 |
| 2,573,794 | 11/1951 | Kueneman | 312/312 X |
| 3,531,895 | 10/1970 | Appell | 49/360 |
| 3,714,737 | 2/1973 | Fillion et al. | 49/360 |

FOREIGN PATENT DOCUMENTS

| | | | |
|---|---|---|---|
| 2418193 | 10/1975 | Fed. Rep. of Germany | 312/138 R |
| 3314388 | 5/1984 | Fed. Rep. of Germany | 108/147 |
| 1169499 | 12/1958 | France | 49/360 |
| 2373251 | 8/1978 | France | 108/147 |
| 1128392 | 9/1968 | United Kingdom | 49/360 |

*Primary Examiner*—Peter A. Aschenbrenner
*Assistant Examiner*—Thomas A. Rendos
*Attorney, Agent, or Firm*—Guido Modiano; Albert Josif

[57] ABSTRACT

The showcase structure comprises a base member, a lid member located substantially opposite the base member, and walls extending upwardly between the lid and base. The structure further comprises a frame, adapted for peripherally surrounding one of the walls, and having a pair of hydraulic cylinders associated therewith, for raising the wall surrounded by the frame.

2 Claims, 3 Drawing Figures

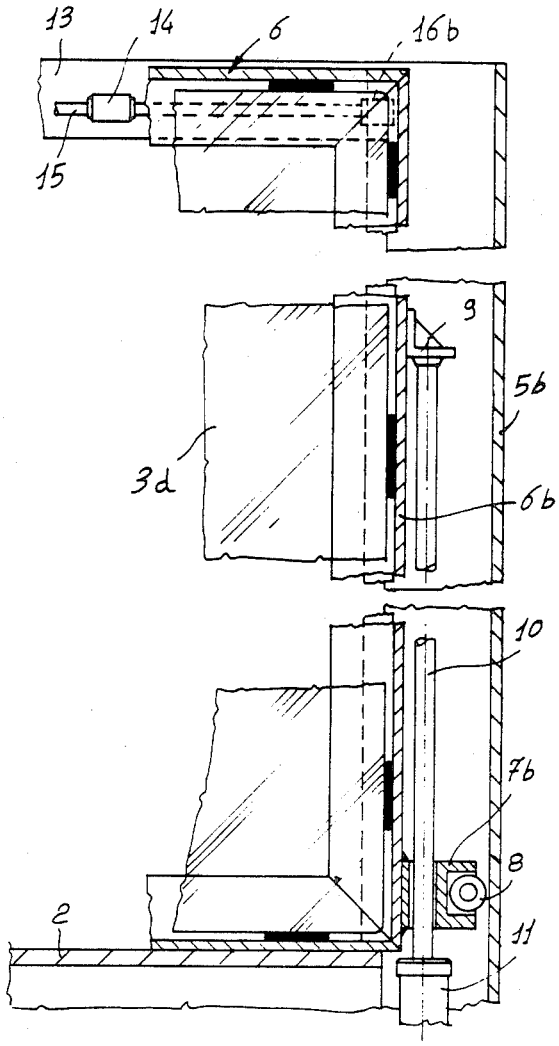
FIG. 2
FIG. 3
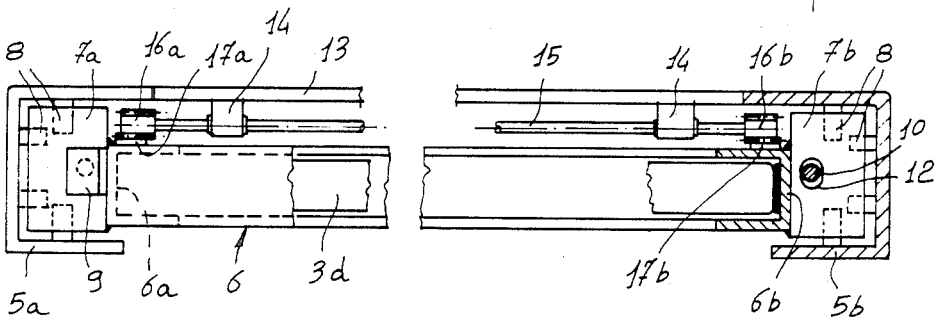

SHOWCASE STRUCTURE

BACKGROUND OF THE INVENTION

This invention relates to a showcase structure, in particular for museums, libraries, showrooms, and the like.

As is known, for containing valuable objects, safety showcases are used which have thick glazed walls. Owing to the weight and encumbrance of such showcases, access to their interiors for periodical cleaning and maintenance work, as well to exchange the objects contained therein, is in general a highly complex and expensive operation. Usually, in fact, several persons are required, and often also such auxiliary equipment as hoists and the like, are employed, to lift said glass panes.

As a consequence, moreover, such showcases are unsuitable for use in setting up periodical exhibitions, that is where the objects on show are to be frequently exchanged.

SUMMARY OF THE INVENTION

It is the technical aim of this invention to obviate such disadvantages by providing a showcase structure, which is secure, and has facilitated access features for periodical maintenance and replacement of its contents.

Within the above aim, it is a further object of the invention to provide a showcase structure which is simple in design, extremely robust, reliable, and functionally effective.

That aim and object and other objects which will become apparent hereinafter are achieved, according to the invention, by this facilitated access safety showcase, of the type which comprises a box-type base whose walls extend upwards, and a top closure lid, characterized in that one of said walls is at least partially surrounded by a frame, is adapted to guide vertical movement between two side uprights which rise from said base, and is adapted to be raised by means of a pair of hydraulic cylinders mounted vertically at said uprights and being connected to said frame.

BRIEF DESCRIPTION OF THE DRAWINGS

The invention will be more clearly understood from the following detailed description of a preferred embodiment of this showcase structure with reference to the accompanying illustrative non-limitative drawings, wherein:

FIG. 2 is a fragmentary, partly sectional front elevation view, of a movable wall and a lateral upright element of the showcase structure of FIG. 1; and FIG. 3 is a fragmentary, partly sectional top plan view of the movable wall and the frame of the showcase structure according to the invention.

DESCRIPTION OF THE PREFERRED EMBODIMENT

Figure 1:
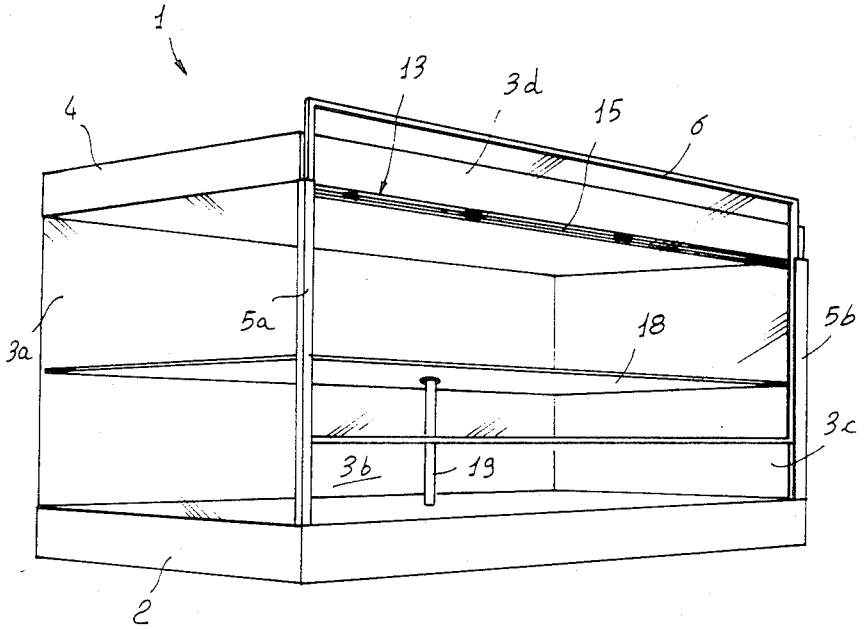
FIG. 1 is a perspective view of the showcase structure according to the invention.

With reference to the above-cited drawing figures, the showcase structure according to the invention is generally indicated by the reference numeral 1.

The showcase 1 comprises a box-like base or base member 2 having substantially the form of a parallelepiped wherefrom side walls extend vertically upwards which may advantageously comprise respective glass panes *3a, 3b, 3c,* and *3d.* The glass panes *3a, 3b, 3c* are expediently fixed to the base member 2 and have a top closure lid or lid member 4 mounted thereon which may be conveniently provided with means of lighting the interior of the showcase.

It will be appreciated that whilst reference is made to walls consisting of glass panels or panes, the walls may be made of any material which meets contingent requirements, though obviously at least one of the walls should be made of at least partially transparent material.

At the front end of the glass panes *3a, 3c*, there are attached to the base 2 a pair of uprights *5a, 5b* which have opposed U-shaped cross-sections. The uprights *5a, 5b* guide the glass pane *3d* vertically which is surrounded by a peripheral frame 6, conveniently provided with internal seals.

Proximately to the bottom end of the vertical sections *6a, 6b* of the frame 6, there are secured respective yokes *7a, 7b* which carry a plurality of rollers 8 rotatably thereon which are adapted to roll over the inside faces of the uprights *5a, 5b.*

Also attached to the vertical sections *6a, 6b* of the frame 6 is fixed, by means of respective brackets 9, the top end of a piston rod 10 of a respective hydraulic cylinder 11, expediently arranged substantially vertically at the uprights *5a, 5b,* respectively.

The rods 10 are passed through an appropriate bore 12 in the yokes *7a, 7b.*

The uprights *5a, 5b* are made rigid with each other at the top ends thereof by a crosspiece 13 which carries rotatably, through bushings or similar bearing means 14, a substantially horizontal shaft or torsion shaft 15. The shaft has, keyed to its ends, a pair of pinions *16a, 16b* which are adapted to mesh with respective racks *17a, 17b* attached vertically to the sections *6a, 6b* of the frame 6.

The operation of the showcase will be readily understood from the foregoing description. Simultaneous operation of the cylinders 11 results in the glass pane *3d* being raised to provide access to the showcase interior.

It should be noted that during lifting movement the pinions *16a, 16b* as being in mesh engagement with the racks *17a, 17b* ensure proper raising and lowering of the frame 6 of the glass pane *3d.*

Expediently, the showcase may be provided on its interior with at least one intermediate rest shelf 18 supported on a pillar 19, formed in turn by the piston rod of a respective cylinder which affords adjustment thereof at a desired elevation.

The hydraulic cylinders are suitably operated by a control unit advantageously located together with any associated pipes, pump means, valve means etc., in the base of the showcase. Obviously, such control unit and associated members may be of any selected appropriate type. In practicing the invention, the materials used, and the shapes and dimensions, may be any ones contigent on requirements.

Thus, for example, the lid and the base may comprise hexagonal, octagonal or even a circular element having a curved section movable wall associated therewith.

We claim:

1. A showcase structure comprising a base member, side walls extending vertically from said base member and defining two vertical front ends, a lid member mounted on said side walls, a vertically movable side wall, a frame surrounding said movable side wall and having two vertical lateral sections, said vertical sections including lower portions, a pair of parallel uprights rigidly attached vertically to said front ends and having opposed U-shaped cross sections, said parallel uprights having top ends, a cross-piece horizontally connecting said top ends, wherein according to the improvement said structure further comprises yoke means, rigidly attached to said lower portions of said vertical sections and laterally projecting therefrom, bores formed in said yoke means, rolling means carried by said yoke means and adapted for slidably guiding said frame along said uprights, hydraulic cylinder means arranged inside said base member, said hydraulic means having rods extending through said bores and laterally attached to said vertical sections.

2. A showcase as defined in claim 1 further comprising a horizontal shaft rotatably supported inside said crosspiece, rack means rigidly fixed to said vertical sections and two pinions rotatably secured to said shaft and meshing with said rack means.

* * * * *